US006510765B2

(12) United States Patent
Mu-Lin

(10) Patent No.: US 6,510,765 B2
(45) Date of Patent: Jan. 28, 2003

(54) STRUCTURE OF A RATCHET WHEEL HAVING A RATCHET WHEEL ALLOWING A SMOOTH TEETH RETURNING AFTER APPLICATION OF THE RATCHET WRENCH

(76) Inventor: Chen Mu-Lin, P.O. Box 82-144, Taipei (TW)

( * ) Notice: Subject to any disclaimer, the term of this patent is extended or adjusted under 35 U.S.C. 154(b) by 0 days.

(21) Appl. No.: 09/880,999

(22) Filed: Jun. 15, 2001

(65) Prior Publication Data

US 2002/0189407 A1 Dec. 19, 2002

(51) Int. Cl.[7] ..... B25B 13/46
(52) U.S. Cl. ..... 81/63.2; 81/60
(58) Field of Search ..... 81/60, 61, 62, 81/63, 63.1, 63.2

(56) References Cited

U.S. PATENT DOCUMENTS 2,803,980 A * 8/1957 Vogel ..... 81/62
3,233,481 A * 2/1966 Bacon ..... 81/63
5,450,773 A * 9/1995 Darrah et al. ..... 81/63.1
6,101,902 A * 8/2000 Wei ..... 81/63

* cited by examiner

*Primary Examiner*—Eileen P. Morgan
*Assistant Examiner*—Joni B. Danganan
(74) *Attorney, Agent, or Firm*—Leong C. Lei

(57) ABSTRACT

An improved structure of a ratchet wrench is disclosed. The structure has a plurality of engaging teeth on a teeth member and a ratchet wheel, characterized in that at least a cavity hole is appropriately provided on the engaging teeth and is mounted with an elastic body therein, thereby, when the teeth member is engaged with the ratchet wheel, the elastic body of the engaging teeth produces a small gap, by the elastic force of the elastic body, between the teeth member and the ratchet wheel, allowing a smooth teeth-returning between the teeth member and the ratchet wheel.

1 Claim, 8 Drawing Sheets

STRUCTURE OF A RATCHET WHEEL HAVING A RATCHET WHEEL ALLOWING A SMOOTH TEETH RETURNING AFTER APPLICATION OF THE RATCHET WRENCH

BACKGROUND OF THE INVENTION (a) Field of the Invention

The present invention relates to an improved structure of a ratchet wrench, and in particular, a ratchet wheel allowing a smooth teeth returning after application of the ratchet wrench.

(b) Description of the Prior Art

Conventional dual-direction ratchet wrench has been disclosed in U.S. Pat. No. 5,626,062, entitled "Socket and Ratchet Wrench, Taiwan Publication No. 262785, entitled "Driving Mechanism of a Hand tool", U.S. Pat. No. 5,230,262, entitled "Ratchet Wrench", Taiwan application no. 88217482, Taiwan Publication No. 399509, entitled "An Improved Structure of a Direction Control Wrench", Taiwan Patent Application No. 84201243, Publication No. 281946, entitled "Driving Structure of a Hand tool", and Taiwan Patent Application No. 88212192, Taiwan Publication No. 386476, entitled "An Improved Structure of a Wrench".

The structure of these conventional prior art has the following drawbacks:

As the wall of the ratchet wrench has no contact with the teeth member, and the ratchet wheel is restricted by the tightening member to provide free rotation, a tooth returning is achieved as the spring force at the rear section of the teeth member is overcome. However, if the tightening member is loosened to a certain extent, owing to a smaller resistance within the screw hole of the tightening element, i.e., there is no resistance to act against the ratchet wheel, if the resistance of the ratchet wheel is lesser than the elastic force at the rear section of the teeth member, teeth-retaining of the teeth member will not be occurred. Thus, in the case of clockwise or counterclockwise rotation of the ratchet wrench, the teeth member can drive the ratchet wheel to rotate the tightening member. This is the drawback of common ratchet wrench. If this happens, the ratchet wrench and the tightening member are separated so as to screw the tightening member manually. Accordingly, it is an object of the present invention to provide an improved structure of a ratchet wrench, which mitigates the above drawbacks.

SUMMARY OF THE INVENTION

Accordingly, it is an object of the present invention to provide an improved structure of a ratchet wrench, wherein the ratchet wrench provides a high torque dual-direction rotation function.

Yet another object of the present invention to provide an improved structure of a ratchet wrench having a plurality of engaging teeth on a teeth member and a ratchet wheel, characterized in that at least a cavity hole is appropriately provided on the engaging teeth and is mounted with an elastic body therein, thereby, when the teeth member is engaged with the ratchet wheel, the elastic body of the engaging teeth produces a small gap, by the elastic force of the elastic body, between the teeth member and the ratchet wheel, allowing a smooth teeth-returning between the teeth member and the ratchet wheel.

Other object and advantages of the present invention will become more apparent from the following description taken in conjunction with the accompanying drawing.

DETAILED DESCRIPTION OF THE PRESENT INVENTION

Figure 1:
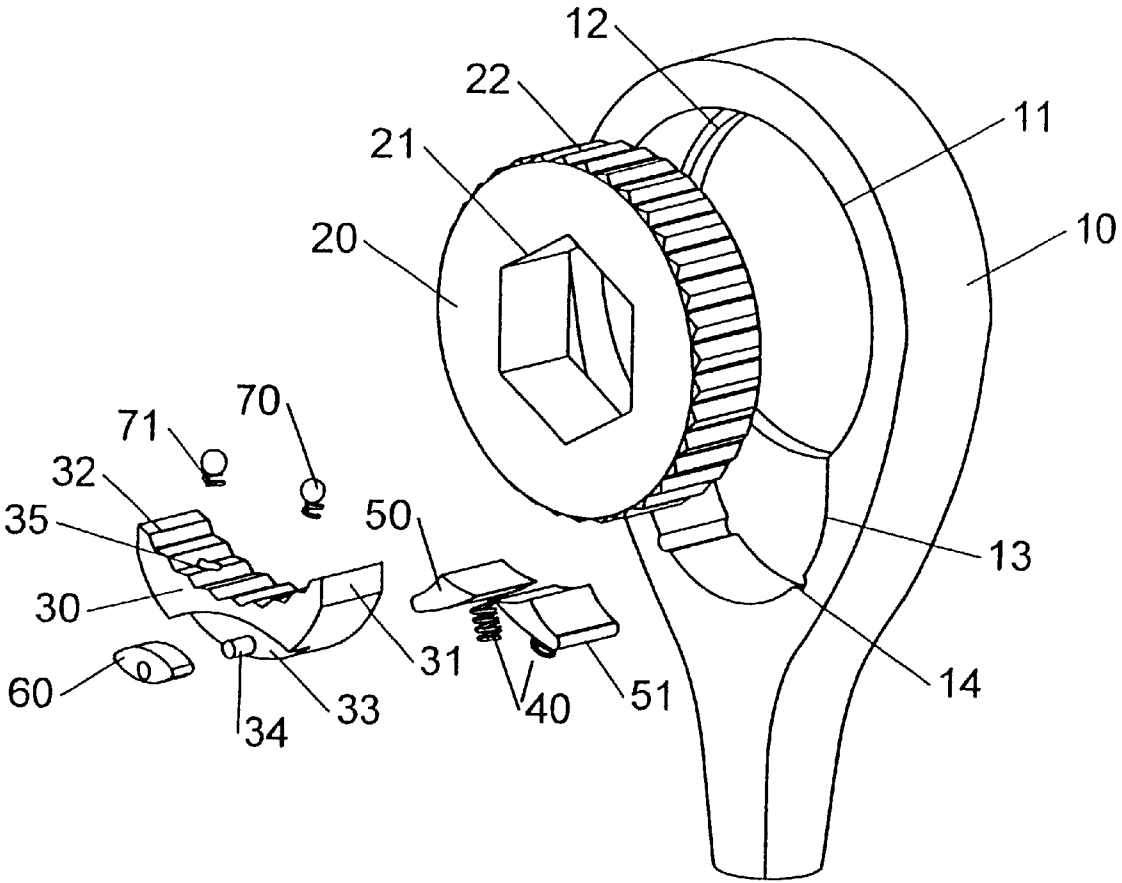
FIG. 1 is a perspective exploded view of the ratchet wrench of the present invention.

Referring to FIG. 1, there is shown an improved structure of a ratchet wrench 10 having a plurality of engaging teeth 32 on a teeth member 30 and a ratchet wheel 20, characterized in that at least a cavity hole 35 is appropriately provided on the engaging teeth 32 and is mounted with an elastic body therein, thereby, when the teeth member 30 is engaged with the ratchet wheel 20, the elastic body of the engaging teeth 32 produces a small gap, by the elastic force of the elastic body, between the teeth member 30 and the ratchet wheel 20, allowing a smooth teeth-returning between the teeth member 30 and the ratchet wheel 20.

As shown in FIG. 1, the ratchet wrench 10 is provided with a holding hole 11 having a bottom end formed into an engaging edge 12. A ratchet wheel 20 is mounted within the holding hole 11 and is having an external edge with a plurality of biting teeth 22. A hexagonal slot 21 or other shape of slot is formed at the center region of the ratchet wheel 20 to accommodate a tightening element. One side of the holding hole 12 is provided with a cavity slot 13 having a space to hold the teeth member 30, a direction block 60, two resisting members 50 and two elastic bodies 40. At an appropriate position on the holding slot 13, two resisting edges 14 are provided. The teeth member 30 is an arch-shaped structure having a notch 33. A pivotal rod 34 is protruded from the notch 33. The direction block 60 is provided to the pivotal rod 34 the center of the direction block 60 has a pivotal hole for pivotal mounting of the pivotal rod 34. One side of the teeth member 30 is provided with a plurality of engaging teeth 32 for mounting with the biting teeth 22 of the ratchet wheel 20.

Figure 2:
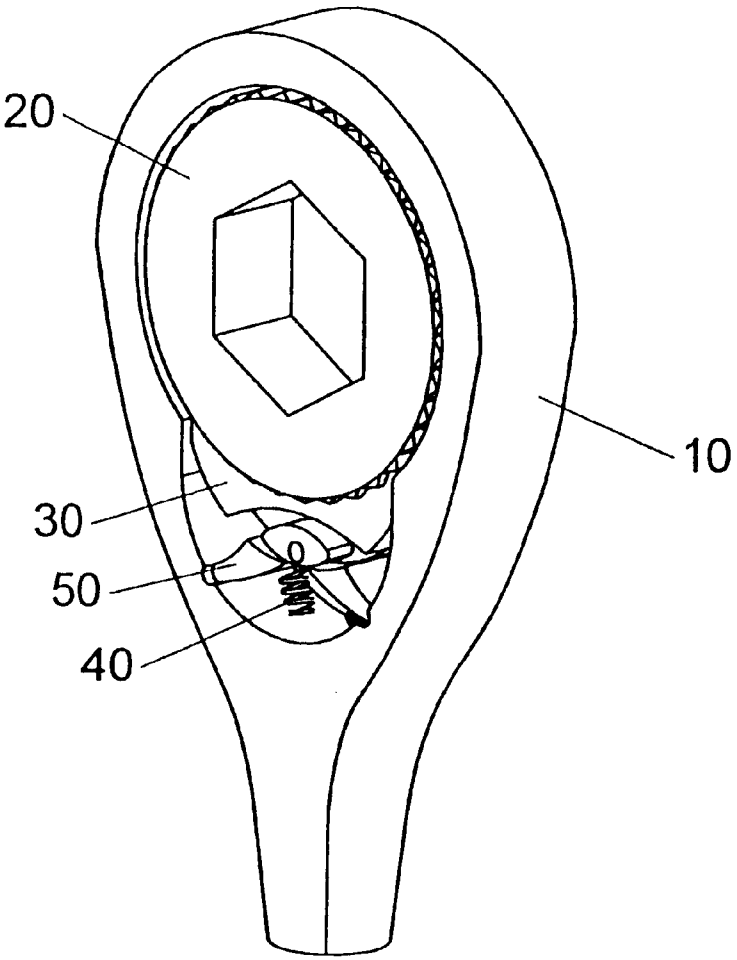
FIG. 2 is an exploded view of the ratchet wheel of the present invention.

The teeth surface of the engaging teeth 32 is provided with at least a cavity hole 35. The inside of the cavity hole 35 is mounted with a steel bead 70 and an elastic member 71. The two lateral sides of the teeth member 30 are formed into a resisting face 31 urging against the two side surface of the holding slot 13. A left and right resisting member 50 urges the other side surface. The top end of the two resisting member 50 are formed into resisting faces which can resist the bottom end of the resisting teeth 30. The tail end of the two resisting members 50 is formed into resisting edge 51, urging against the resisting edge 14 of the holding slot 13. The two resisting elements 50 are urged by the elastic body 40 such that the teeth member 30 is in engagement with the ratchet wheel 20 of the elastic body 40. The other end of the elastic body urges at one side surface of the holding slot 13. The improved structure of the ratchet wrench is shown in FIG. 2.

A panel is used to cover the ratchet wheel. The ratchet wheel 10 is provided with a plurality of screw holes, and the panel is screwed onto the ratchet wrench 10. A slot is provided to the panel, corresponding to the direction block 60, a rotating button and a direction block are mounted, such that the external rotating of the direction button controls the left and right rotating of the direction block 60.

Figure 3:
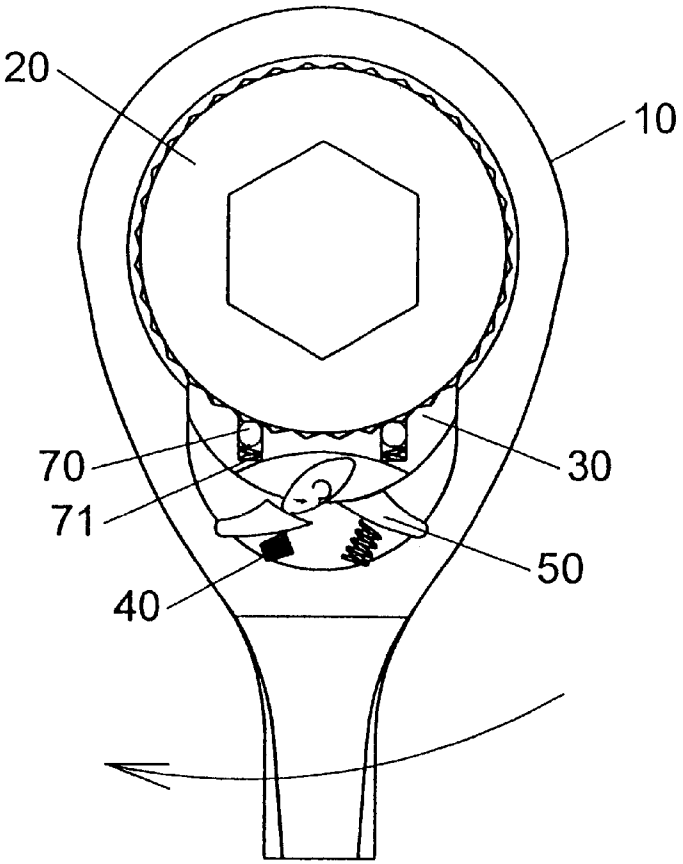
FIG. 3 is a schematic view showing clockwise direction of the ratchet wrench of the present invention.

Referring to FIG. 3, when in rotation, the direction block 60 is rotated and the left resisting member 50 is pressed so that the left resisting member 50 is dislocated from the teeth member 30, by clockwise rotating of the ratchet wrench 10, the ratchet wrench 10 presses against the right resisting member 50, and the right resisting member 50 presses the teeth member 30. Thus, clockwise rotating of the ratchet wrench 20 will tight a mounting element.

Figure 4:
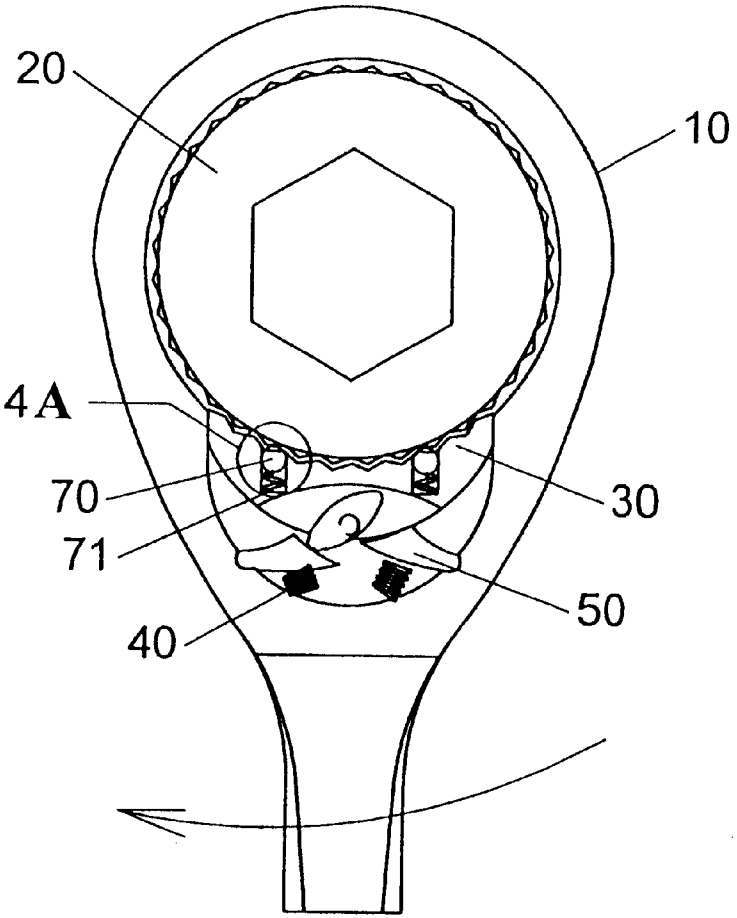
FIG. 4 is a schematic view showing a teeth-skip of the ratchet wrench of the present invention.
Figure 4A:
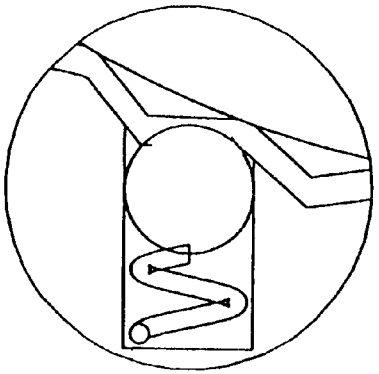
FIG. 4A is an enlarged view of a portion FIG. 4.

When the ratchet wrench 10 moves counterclockwise, the tightening member restricts the ratchet wheel 20 and the direction block 60 pushes left resisting member 50. Thus, the ratchet wrench 10 cannot drive the teeth member 30 to rotate the ratchet wheel 20. At this instance, the teeth member 30 does not urge by the interior of the ratchet wrench 10, and the steel bead 70 and the elastic member 71 are mounted to the engaging teeth 32. That is, the teeth member 30 is separated from the ratchet wheel 20 with a small distance. Thus, "teeth-skip" is formed between the ratchet wheel 20 and the teeth member 30, which is shown in FIGS. 4 and 4A.

In accordance with the present invention, an elastic body is mounted to the engaging teeth 32 of the teeth member 30 to allow smooth returning of teeth member 30 with the ratchet wheel 20. That is, when the resistance force of the tightening member in the course of rotating the tightening member, the function of teeth returning is achieved.

Figure 5:
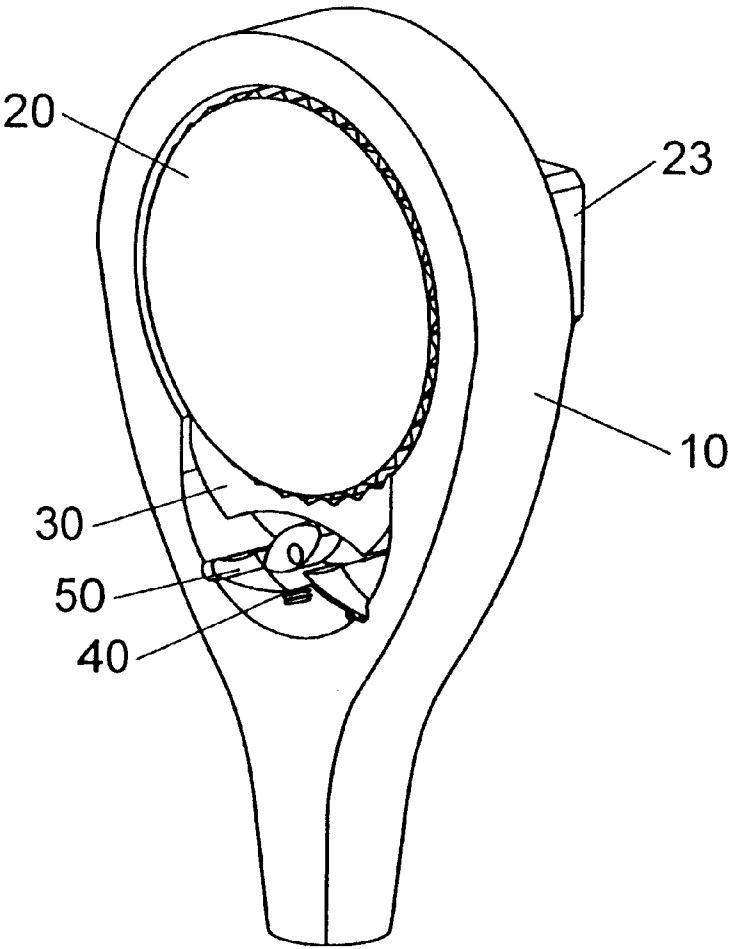
FIG. 5 is a schematic view of another preferred embodiment of the ratchet wrench of the present invention.
Figure 6:
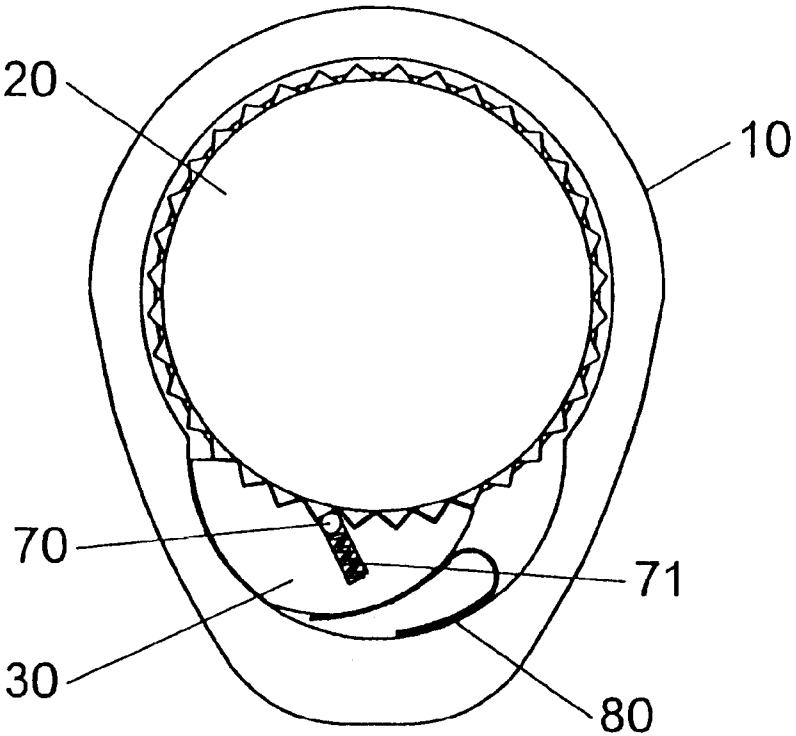
FIGS. 6 to 8 are other preferred embodiments in accordance with the present invention.

Referring to FIG. 5, the present invention can be employed together with common combination wrench, wherein a mounting end 23 is protruded from the ratchet wheel 10, and the mounting end 23 can be mounted with sockets of various shapes.

When the present invention is used in a single direction ratchet wrench 10, a cavity hole 35 is provided on the teeth member and a bead and an elastic member 71 are mounted into the cavity hole 35, allowing a smooth teeth returning of the ratchet wrench.

Figure 7:
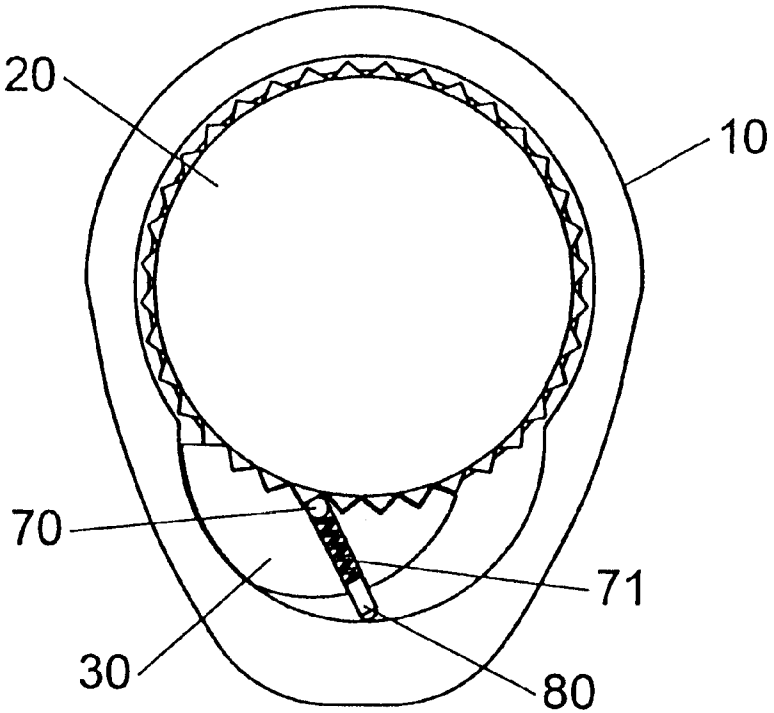

If the present invention is used in other ratchet wrench 10, referring to FIG. 7, a cavity hole 35 is provided on the teeth member 30, and a steel bead 70 and an elastic member 71 are mounted into the cavity hole 35, allowing a smooth teeth-returning of the ratchet wrench.

Figure 8:
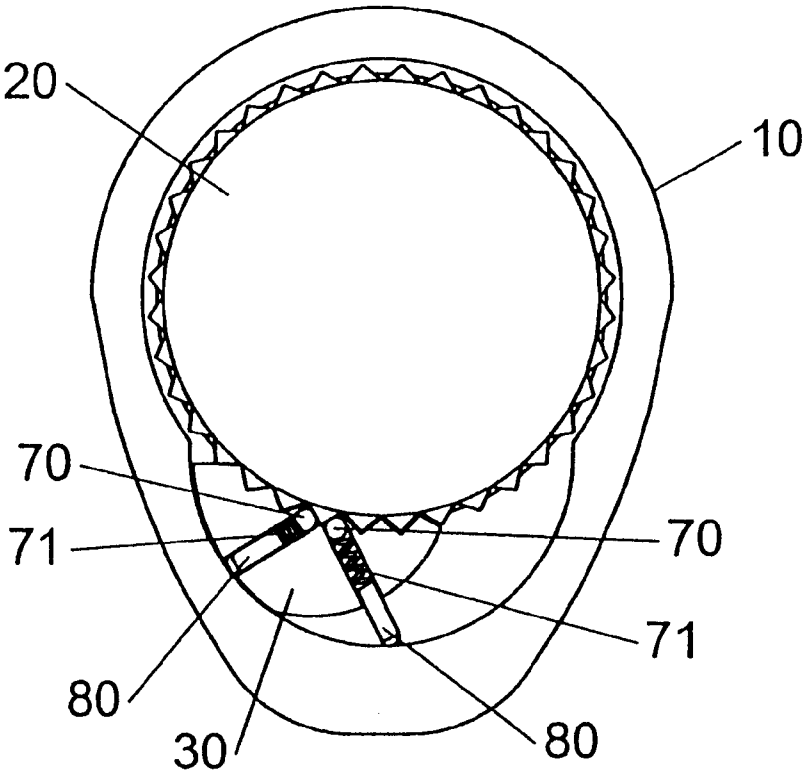

When the present invention is employed in dual-direction ratchet wheel 10, referring to FIG. 8, there are provided with two cavity holes 35, two steel beads 70, two elastic members 71 and two urging members. When the teeth members 30 urge one side of the holding slot 13, a dual-direction rotation of the ratchet wrench is obtained.

Another example of the present invention is that other than the steel bead 70 and the elastic member 71, other elastic bodies can be employed.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A ratchet wrench comprising:

a ratchet wheel;

a teeth member having a plurality of engaging teeth and at least one cavity hole through the teeth member; and an elastic body mounted within each cavity hole, each elastic body comprising a steel bead and an elastic member, whereby when the teeth member is engaged with the ratchet wheel, the elastic body produces a small gap between the teeth member and the ratchet wheel, allowing a smooth teeth-returning between the teeth member and the ratchet wheel.

* * * * *